US011590385B2

(12) United States Patent
Knapp

(10) Patent No.: US 11,590,385 B2
(45) Date of Patent: Feb. 28, 2023

(54) DEVICE FOR ADAPTING EXERCISE WEIGHTS FOR USE AS GRIP PLATES

(71) Applicant: Jesse Knapp, Franklin, TN (US)

(72) Inventor: Jesse Knapp, Franklin, TN (US)

( * ) Notice: Subject to any disclaimer, the term of this patent is extended or adjusted under 35 U.S.C. 154(b) by 150 days.

(21) Appl. No.: 17/114,114

(22) Filed: Dec. 7, 2020

(65) Prior Publication Data

US 2021/0187344 A1 Jun. 24, 2021

Related U.S. Application Data

(60) Provisional application No. 62/974,707, filed on Dec. 19, 2019.

(51) Int. Cl.
*A63B 21/00* (2006.01)
*A63B 21/072* (2006.01)

(52) U.S. Cl.
CPC ..... *A63B 21/4035* (2015.10); *A63B 21/072* (2013.01)

(58) Field of Classification Search
CPC ..... A63B 21/0004; A63B 21/072; A63B 21/0722; A63B 21/0724; A63B 21/0726; A63B 21/0728; A63B 21/075; A63B 21/08; A63B 21/4023; A63B 21/4027; A63B 21/4033; A63B 21/4035; A63B 21/4043
See application file for complete search history.

(56) References Cited

U.S. PATENT DOCUMENTS 4,345,756 A * 8/1982 Hoagland ..... A63B 21/072 482/109
4,431,185 A * 2/1984 Cisneros ..... A63B 21/072 220/318
5,454,551 A * 10/1995 Hobday ..... B25B 5/06 269/170
5,879,274 A * 3/1999 Mattox ..... A63B 21/0728 482/93
6,196,951 B1 * 3/2001 Shepherd ..... A63B 23/1263 482/106
6,689,022 B1 * 2/2004 Emick ..... A63B 21/06 482/93
7,048,674 B2 * 5/2006 Hartman ..... A63B 23/14 482/93
10,188,895 B1 * 1/2019 Wallace ..... A63B 21/0726
(Continued)

FOREIGN PATENT DOCUMENTS

CN 106178425 A * 12/2016

*Primary Examiner* — Gary D Urbiel Goldner
(74) *Attorney, Agent, or Firm* — Patterson Intellectual Property Law, P.C.; Mark A. Kilgore

(57) ABSTRACT

A grip apparatus for attachment to a weight plate is provided for enabling the weight plate to be used as a grip plate like those having integrally formed handles. The grip apparatus may include a grip handle, at least one adapter element, and at least one coupler. The grip handle may circumscribe at least a portion of the weight plate. The at least one adapter element may be coupled to the grip handle and may further be configured to adjustably extend therefrom. The at least one coupler may be coupled to each of the at least one adapter element proximate to a distal end thereof and may further be configured to selectively engage the weight plate. The at least one adapter element may comprise two adapter elements positioned so as to enable the at least one coupler to engage opposite sides of the weight plate.

19 Claims, 12 Drawing Sheets

(56) References Cited

U.S. PATENT DOCUMENTS

| | | | | |
|---|---|---|---|---|
| 10,188,899 | B1 * | 1/2019 | Acuna, Jr. | A63B 21/0442 |
| 2004/0162199 | A1 * | 8/2004 | Connelly | A63B 21/072<br>482/109 |
| 2006/0199709 | A1 * | 9/2006 | Shepherd | A63B 21/072<br>482/109 |
| 2011/0287903 | A1 * | 11/2011 | Mathews | A63B 21/0602<br>482/93 |
| 2012/0053024 | A1 * | 3/2012 | Mendoza | A63B 21/0722<br>482/106 |
| 2013/0040788 | A1 * | 2/2013 | Booker | A63B 21/4015<br>482/106 |
| 2014/0024506 | A1 * | 1/2014 | Vixathep | A63B 21/072<br>482/108 |
| 2014/0179494 | A1 * | 6/2014 | Mathews | A63B 21/0602<br>482/93 |
| 2016/0175640 | A1 * | 6/2016 | Kempton | A63B 21/0726<br>482/106 |
| 2017/0266479 | A1 * | 9/2017 | McCall | A63B 15/00 |
| 2019/0168063 | A1 * | 6/2019 | Kefauver | A63B 71/0036 |
| 2019/0217146 | A1 * | 7/2019 | Sisler | A63B 21/075 |
| 2019/0282847 | A1 * | 9/2019 | Acuna, Jr. | A63B 21/4035 |
| 2019/0366143 | A1 * | 12/2019 | McCall | A63B 21/4035 |
| 2020/0147439 | A1 * | 5/2020 | Acuna, Jr. | A63B 21/4035 |
| 2020/0276469 | A1 * | 9/2020 | Anderson | A63B 21/4047 |
| 2021/0138291 | A1 * | 5/2021 | Pacini | A63B 21/4035 |

* cited by examiner

DEVICE FOR ADAPTING EXERCISE WEIGHTS FOR USE AS GRIP PLATES

CROSS-REFERENCES TO RELATED APPLICATIONS

This application claims benefit under 35 USC. § 119(e) of U.S. Provisional Patent Application No. 62/974,707, filed Dec. 19, 2019, entitled "DEVICE FOR ADAPTING EXERCISE WEIGHTS FOR USE AS GRIP PLATES."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present invention generally relates to barbell and weight exercise equipment. More particularly, the present disclosure relates to a grip adaptor for weights plates to be used as grip plates.

BACKGROUND

Weight training can be traced to nearly the beginning of history. While ancient civilizations relied on large rocks for weightlifting, modern weights include barbells, dumbbells, kettle bells, weight plates, and a host of unconventional free weights, each with machines, adaptors, harnesses, and other equipment for adapting the weights for specific exercises. Weight plates are discs of heavy material which can be either lifted on their own or equipped to a bar or other machine to be lifted in tandem with other weight plates.

As shown in FIGS. 1 and 2, grip plates 10 are often similar to traditional weight plates but with handles 12 defined along the outer rim 14 of the metal disc so that the weight can be grasped and lifted by the handles. Grip plates 10 may be used in a variety of exercises such as, for example, the front shoulder raise, pickup, squat reach, and standing twist. Grip plates 10 may grant additional stability and safety to persons trying to perform these exercises over traditional weight plates because the handles 12 may reduce the chance that the weight will slip or be dropped.

While traditional grip plates 12 are an improvement upon the traditional weight plate and can provide additional utility to users, they are still limited in a variety of aspects. First, grip plates 10 are manufactured in different sizes (i.e., different diameters 16) based upon the weight of the plate. Lighter grip plates 10 have a smaller diameter 16 than heavier grip plates 10 because of the mass difference between the lighter and heavier plates. The handles 12 on these smaller grip plates 10 are therefore often smaller than the handles 12 on the larger grip plates 10 because of the reduced surface area and volume necessary to set the weight of the plate. Thus, the variation in different user's size, flex range, and general comfort level of using weights may be unable to use certain grip plates 10 for some exercises.

Second, the handles 12 of grip plates 10 are fixed along the outer rim 14 and thus cannot be moved or otherwise adjusted to allow for certain exercises or for variation across different users. Because the handles 12 on these grip plates 10 are openings in the plates themselves, the position of the handles 12 cannot be adjusted, nor can more or less handles be added or subtracted. Certain exercises may require a user to grip the plate at certain positions along the outer rim 14 of the plate where the handles 12 may not be located. Thus, a person wanting to perform certain exercises with grip positions different than the locations of the handles 12 would need to purchase an entirely new set of grip plates 10 with handles 12 in different positions.

Third, grip plates 10 are fixed weights and thus do not allow manipulation of the balance point of the weight or oscillation of the weight during use. Contemporary exercises have begun to incorporate unconventional weight stress created by using off-balance weights. Additionally, new exercises are integrating movement of the weight during its use as an additional function for exercise. However, because grip plates 10 have handles 12 defined along the outer rim 14 at fixed positions, the plate cannot be independently rotated or otherwise changed in position during use. The balance of the weight is fixed and permanent. To get a new balance for a weight, a person would be required to purchase an entirely new set of weights for that particular balance exercise. In addition, the handle 12 of the grip weight cannot be changed relative to the plate during use, rendering independent movement of the weight for particular exercises impossible.

BRIEF SUMMARY

Accordingly, a need exists for a grip plate including a fixed diameter regardless of the diameter or weight of the grip plate. Furthermore, a need exists for a grip plate which includes additional or modular grab location options. Another need exists for a grip plate including handles that may rotate relative to the plane of the grip plate for enabling unbalanced movement of the grip plate.

The present invention comprises a grip weight adaptor for exercise weight plates. The grip weight adaptor includes a handle with one or more adaptor elements affixed to the handle and configured to engage an exercise weight plate and regulate the position of the exercise weight plate relative to the handle such that the exercise weight plate may be manipulated by a user using the handle in a similar manner to typical grip plates. In certain embodiments, the handle may be a ring of substantially rigid material and the adaptor element may be spring biased rods positioned through the handle and spaced equidistantly around the handle. For example, the handle may include two or mode adaptor elements positioned equidistantly around the handle and extending from an interior of the handle. The rods when retracted, via the spring or other adjustment mechanism, may allow the weight plate to be place between the two rods prior to release of the rods which may cause the weight plate to be held suspended in the interior of the ring. In certain embodiments, the weight plate may include receptacles defined along the rim for receiving the rods, respectively. In other embodiments, the adaptor element may be a clip, bolt, or the like means of engaging the rim of a particular weight plate. In certain optional embodiments, the handle may be square, tri-angular, or some other irregular shape relative to the weight plate. In other optional embodiments, the adaptor element may engage the weight plate in such a way that the rim of the weight plate is flush against the handle. In still further optional embodiment, the adaptor element may enable limited movement of the weight plate relative to the handle.

One embodiment of a grip apparatus for attachment to a weight as disclosed herein comprises, a grip handle, at least one adapter element, and at least one coupler. The at least one adapter element may be coupled to the grip handle and may be configured to adjustably extend therefrom. The at least one coupler may be configured to selectively engage the weight. Each of the at least one coupler may be attached to a distal end of each of the at least one adapter element.

In one exemplary aspect of the aforementioned apparatus embodiment, the grip handle may be a circular grip.

In another exemplary aspect of the aforementioned apparatus embodiment, the weight may include a weight diameter and the circular grip may include a grip handle diameter larger than the weight diameter.

In another exemplary aspect of the aforementioned apparatus embodiment, the at least one adapter element may include at least two adapter elements equally spaced around the circular grip.

In another exemplary aspect of the aforementioned apparatus embodiment, the grip handle may be configured to circumscribe at least a portion of the weight.

In another exemplary aspect of the aforementioned apparatus embodiment, the at least one adapter element may be configured to bridge an offset between the grip handle and the weight such that at least one of the at least one adapter element or the at least one coupler can engage the weight.

In another exemplary aspect of the aforementioned apparatus embodiment, the at least one adapter element may include a first adapter element and a second adapter element. Each of the first and second adapter elements may be configured to engage opposite sides of the weight.

In another exemplary aspect of the aforementioned apparatus embodiment, the at least one coupler may be configured to frictionally engage a rim of the weight.

In another exemplary aspect of the aforementioned apparatus embodiment, the at least one coupler may be configured to clamp onto a rim of the weight.

An embodiment of a workout weight plate grip system as disclosed herein comprises, a weight plate including a rim and a grip apparatus configured to be coupled to the rim of the weight plate. The grip apparatus may include a grip handle, at least one adapter element, and at least one coupler. The grip handle may be configured to circumscribe at least a portion of the rim of the weight plate. The at least one adapter element may be coupled to the grip handle and configured to adjustably extend therefrom. The at least one coupler may be connected to a distal end of each of the at least one adapter element and may further be configure to selectively engage the weight plate.

In another exemplary aspect of the aforementioned system embodiment, the grip handle may be spaced apart from the rim of the weight plate by an offset distance. The offset distance may be less than or equal to a length of the at least one adapter element.

In another exemplary aspect of the aforementioned system embodiment, the offset distance may be greater than or equal to about 1 inch and may be less than or equal to about 3 inches.

In another exemplary aspect of the aforementioned system embodiment, the weight plate includes at least one recess defined in the rim. At least one of the at least one adapter element or the at least one coupler may be configured to be at least partially inserted into the at least one recess of the weight plate.

In another exemplary aspect of the aforementioned system embodiment, the at least one coupler may be configured to frictionally engage the rim of the weight plate.

In another exemplary aspect of the aforementioned system embodiment, the at least one coupler may be configured to clamp onto the rim of the weight plate.

An embodiment of a method of installing a grip apparatus onto a weight plate as disclosed herein comprises: (a) positioning a grip handle of the grip apparatus such that it circumscribes and is offset from a rim of the weight plate, (b) adjusting at least one adapter element of the grip apparatus to cause at least one coupling means of the grip apparatus to engage the rim of the weight plate, and (c) securely fastening the at least one coupling means to the rim of the weight plate.

In another exemplary aspect of the aforementioned method embodiment, step (c) of the method may further comprise inserting at least a portion of at least one of the at least one adapter element or the at least one coupling means into a recess of the rim of the weight plate.

In another exemplary aspect of the aforementioned method embodiment, step (c) of the method may further comprise adjusting a clamp of the at least one coupling means to surround and engage a portion of the rim of the weight plate.

In another exemplary aspect of the aforementioned method embodiment, step (b) of the method may further comprise moving the at least one adapter element perpendicularly relative to an attachment location on the grip apparatus to adjust a position of the at least one coupling means relative to the weight plate.

In another exemplary aspect of the aforementioned method embodiment, step (c) of the method may further comprise locking a position of the at least one adapter element relative to the grip handle.

Numerous other objects, advantages and features of the present disclosure will be readily apparent to those of skill in the art upon a review of the following drawings and description of a preferred embodiment.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected" and "attached" should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 1:
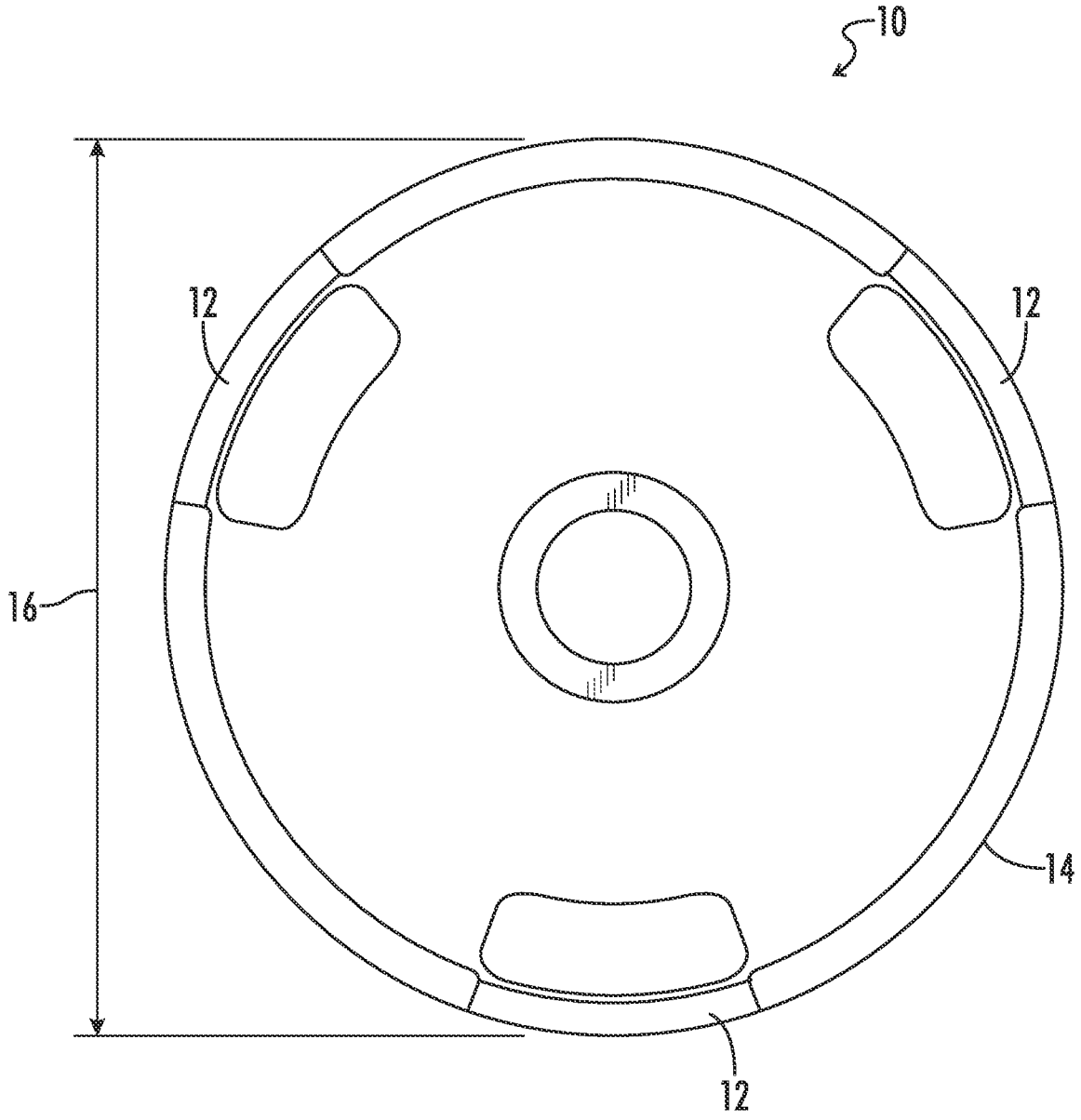
FIG. 1 (PRIOR ART)
FIG. 1 illustrates a front elevation view of typical grip plate having three handles.
Figure 2:
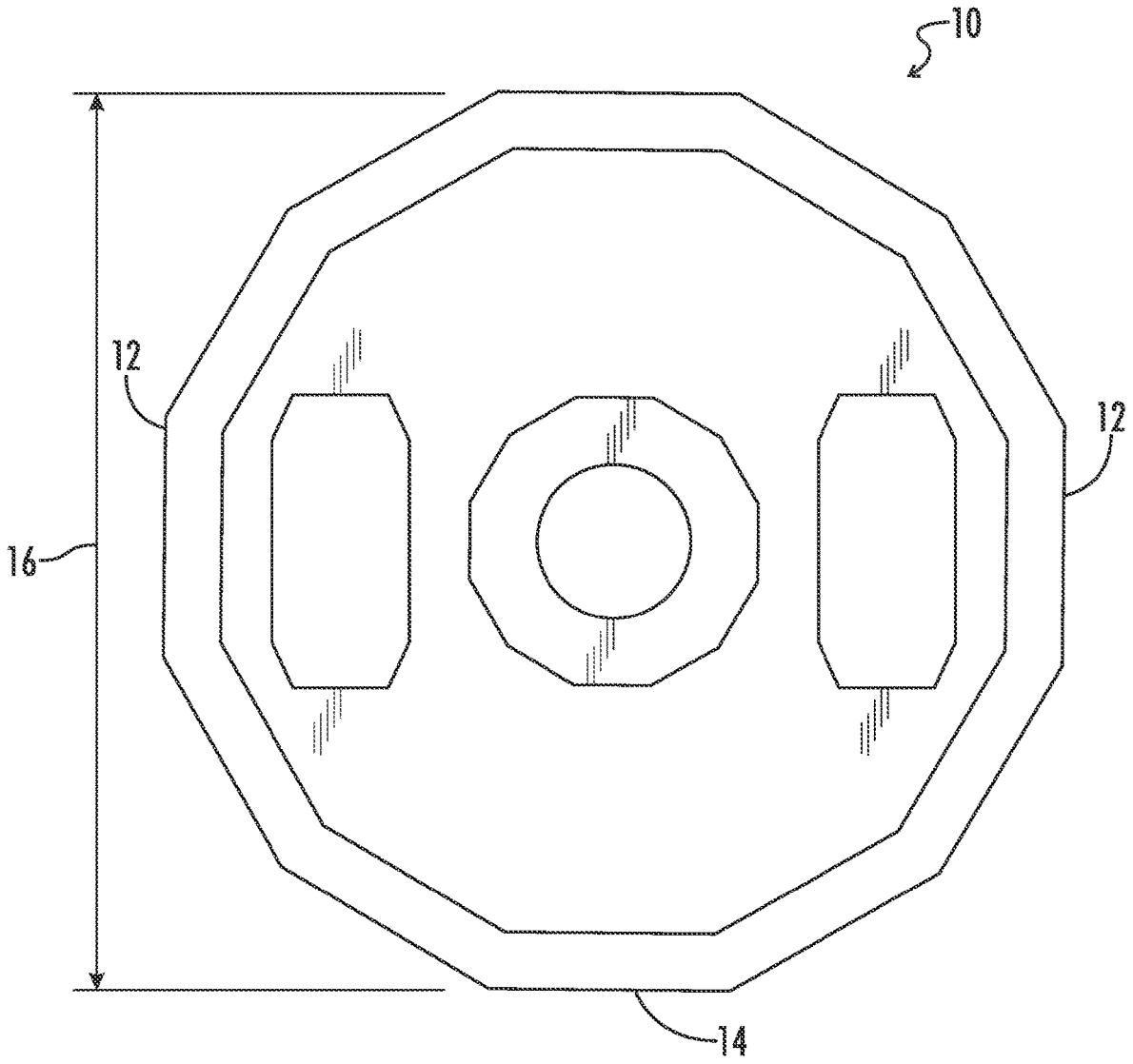
FIG. 2 (PRIOR ART)
FIG. 2 illustrates a front elevation view of typical grip plate having two handles.
Figure 3A:
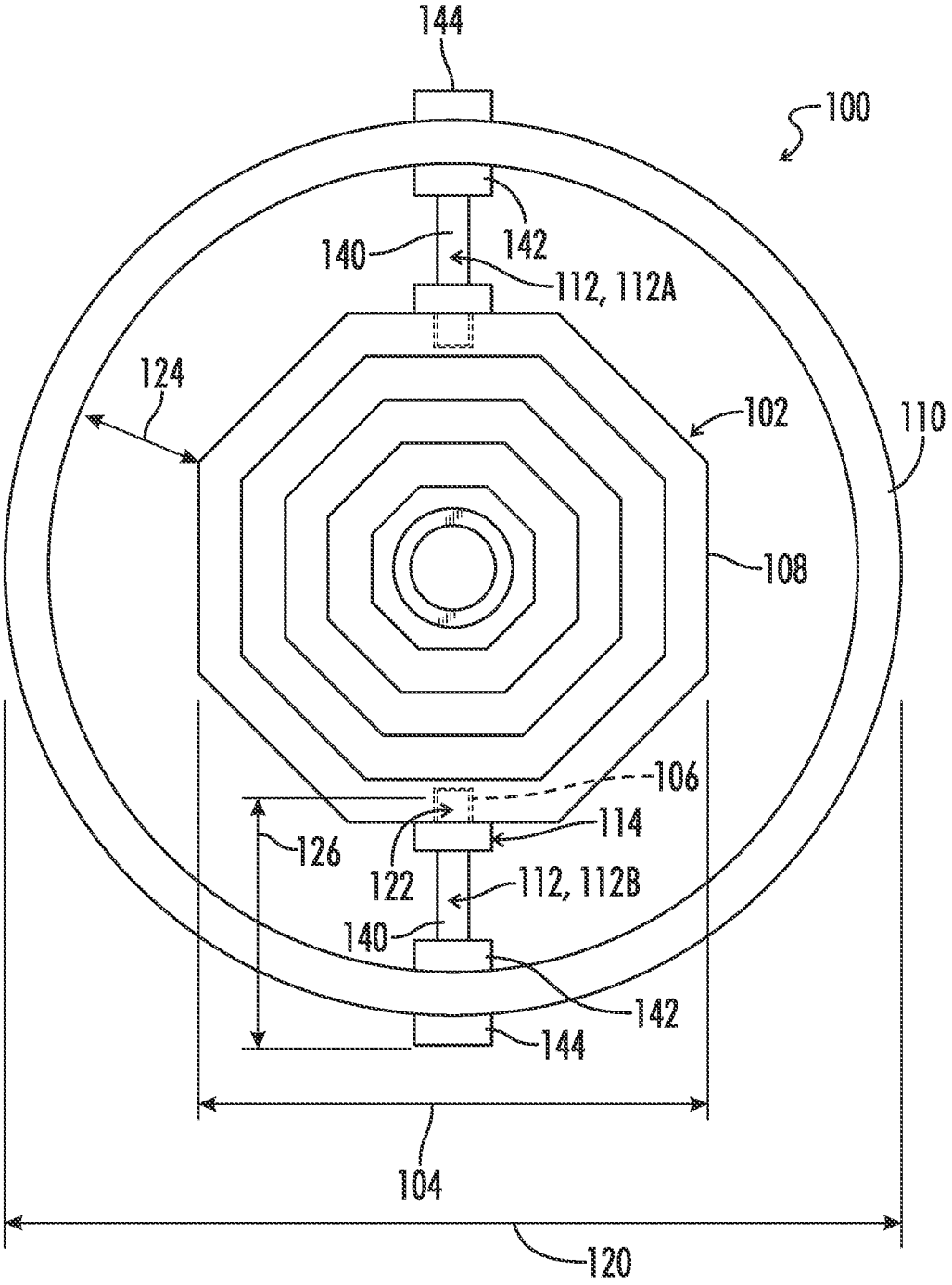
FIG. 3A illustrates a front elevation view of a workout weight plate grip system including a weight plate and a grip apparatus with a circular grip handle coupleable to the weight plate in accordance with the present disclosure.
Figure 3B:
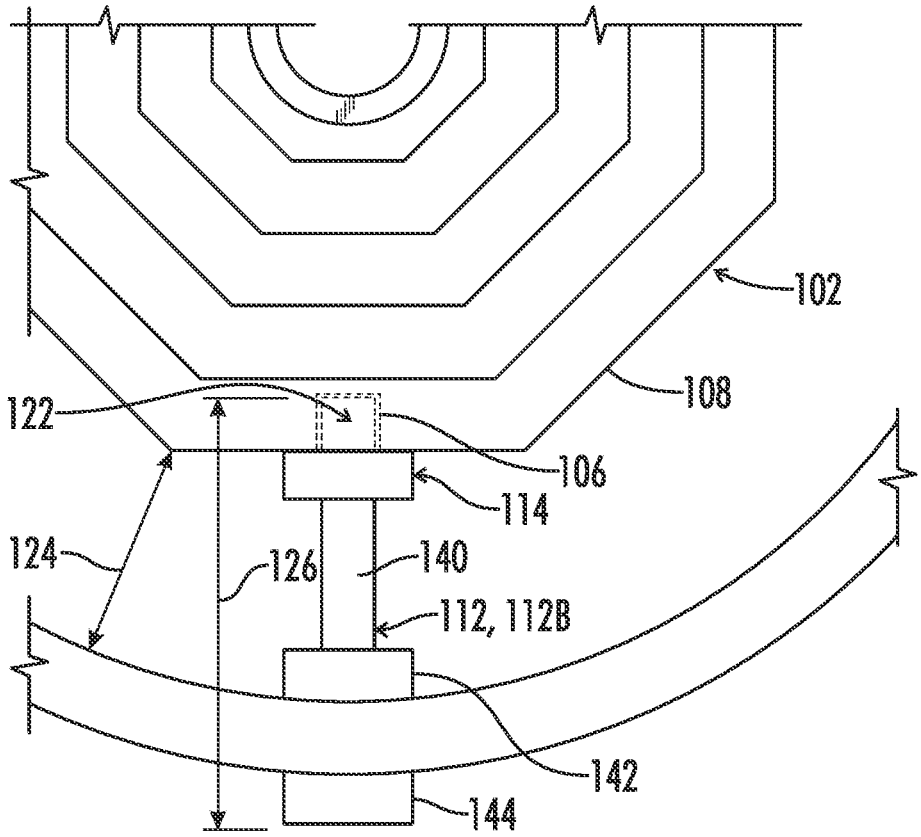
FIG. 3B illustrates an enlarged front elevation view of the workout weight plate grip system of FIG. 3A in accordance with the present disclosure.
Figure 3C:
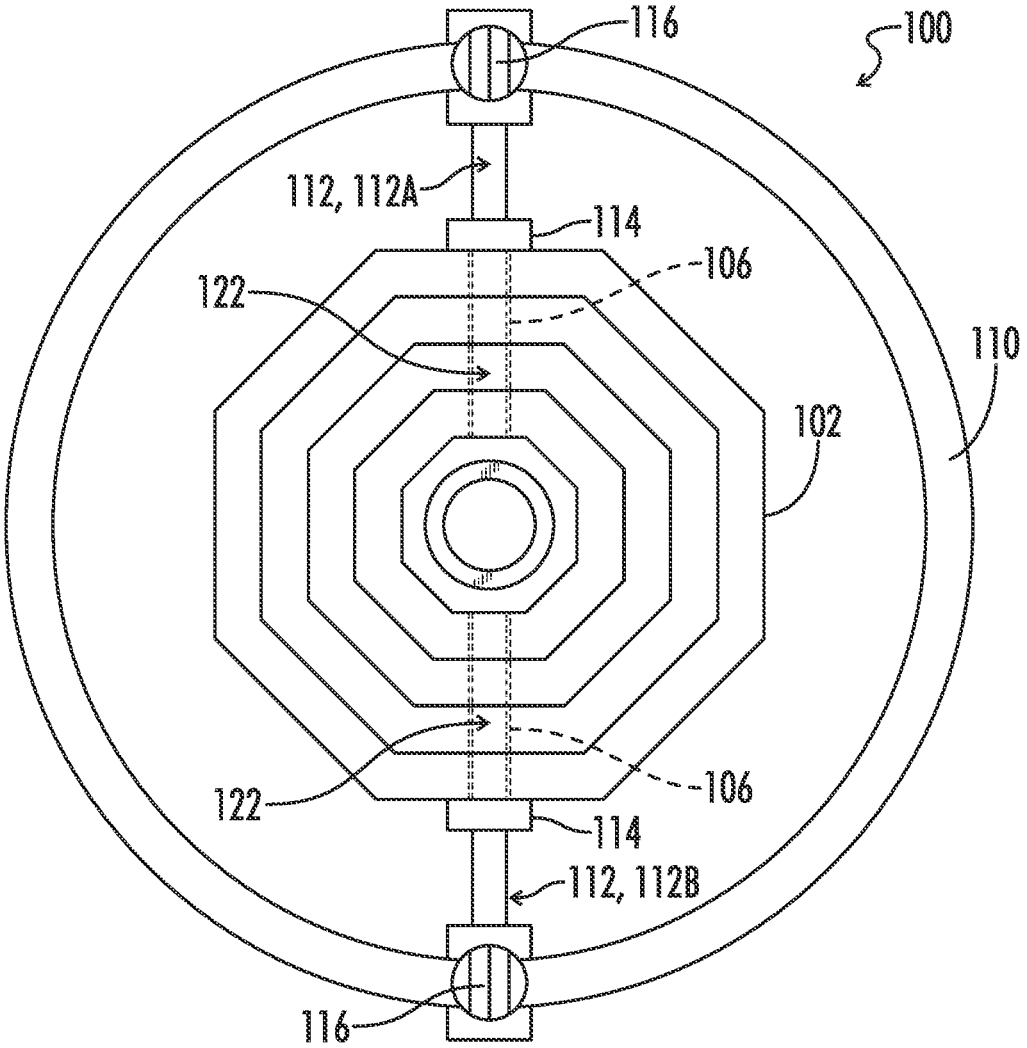
FIG. 3C illustrates a front elevation view of the workout weight plate grip system of FIG. 3A with the circular grip handle thereof having two halves hingedly coupled together in accordance with the present disclosure.
Figure 4:
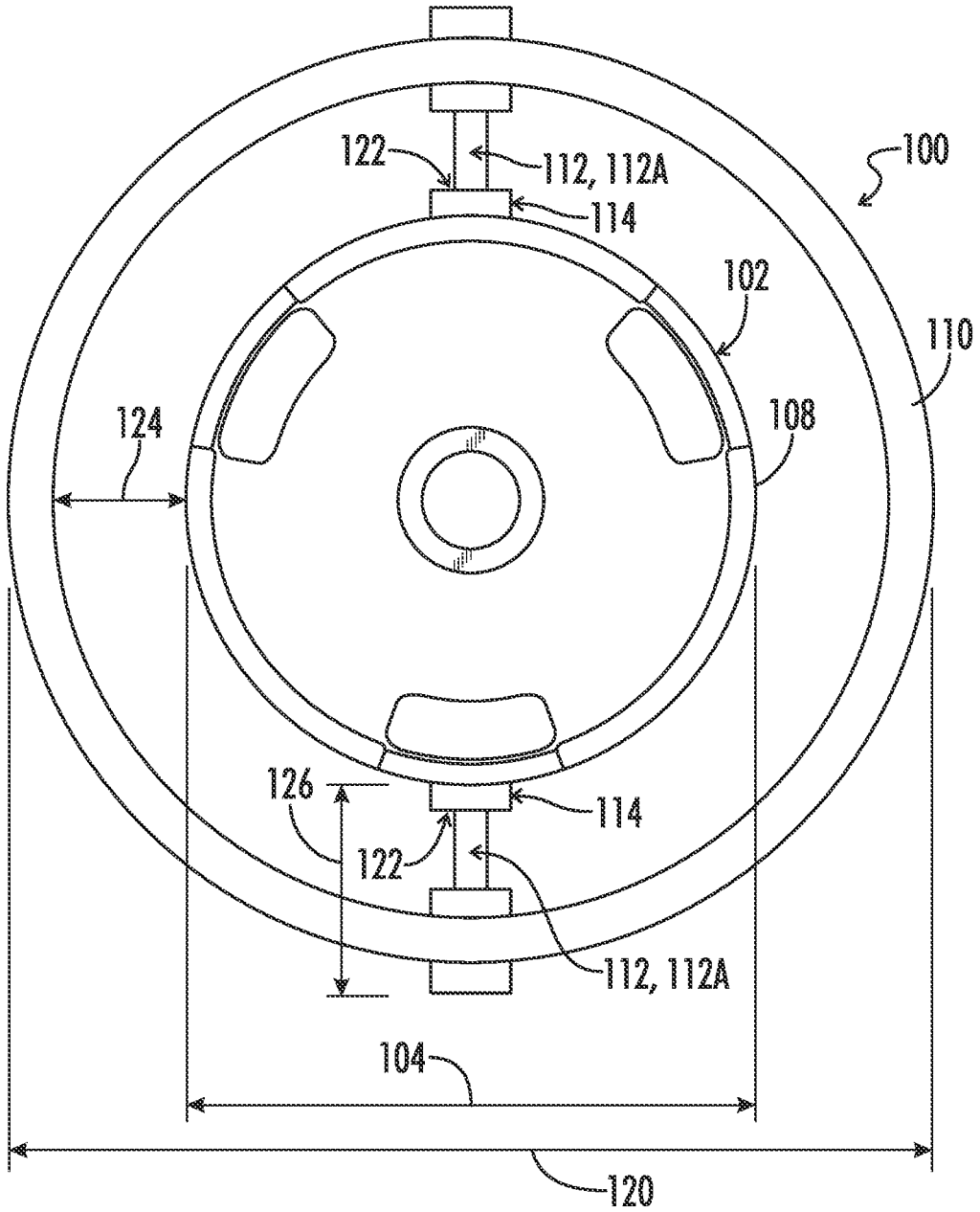
FIG. 4 illustrates a front elevation view of the workout weight plate grip system of FIG. 3A with a circular weight plate in accordance with the present disclosure.

Referring to FIGS. 3A-6, a grip apparatus 100 for attachment to a weight plate 102 is shown. The grip apparatus 100 in combination with the weight plate 102 may be referred to herein as a workout weight plate grip system. The weight plate 102 may be circular (as shown in FIG. 4), hexagonal, octagonal (as shown in FIGS. 3A and 3B), or the like. The weight plate 102 includes a weight plate diameter 104. The weight plate 102 may be one of any number of commercially available weights or may be a weight plate specifically design for attachment to the grip apparatus 100.

The grip apparatus 100 may include a grip handle 110, at least one adapter element 112, and at least one coupler 114. The at least one adapter element 112 may be coupled to the grip handle 110 and may further be configured to adjustably extend therefrom towards the weight plate 102. The at least one coupler 114 may be coupled to each of the at least one adapter element 112 and may further be configured to selectively engage the weight plate 102.

As illustrated the grip handle 110 may be a circular grip handle configured to circumscribe the weight plate 102. The circular grip handle 110 may include a grip handle diameter 120 that is greater than the weight plate diameter 104. In other embodiments, the grip handle 110 may be any other regular or irregular geometric shape. The grip handle 110 may be constructed out of any substantially rigid material such as, for example, rubber, plastic, metal, carbon fiber, wood, or the like. As illustrated in FIGS. 3A, 3B, and 4-8, the circular grip handle 110 may be a single continuous handle. As illustrated in FIG. 3C, the circular grip handle 110 may be split into first and second halves coupled together using a hinge coupler 116 configured to allow the two halves to rotate relative to each other around the at least one adapter element 112.

The at least one adapter element 112 may include first and second adapter elements 112A, 112B equally spaced around the circular grip handle 110. The first and second adapter elements 112A, 112B may engage opposite sides of the rim 108 of the weight plate 102. In other embodiments, the at least one adapter element 112 may include more than two adapter elements equally spaced around the circular grip handle 110.

The at least one coupler 114 may comprise grips, clamps, adhesives, ropes, chains, nets, or the like for removably coupling the grip handle 110 to the weight plate 102. The at least one coupler 114 may further be configured to ensure that the weight plate 102 is held in a substantially fixed position relative to the grip handle 110. As illustrated in FIGS. 3A and 3B, the coupler 114 may be offset from a distal end 122 of the at least one adapter element 112. In accordance with this embodiment, the weight plate 102 may include at least one recess 106 defined in the rim 108 of the weight plate 102. The distal end 122 of the at least one adapter element 112 may be configured to be at least partially inserted into the at least one recess 106 of the weight plate 102 such that the at least one coupler 114 lies flush against the rim 108 of the weight plate 102. In accordance with this embodiment, the at least one coupler 114 may allow the weight plate 102 to spin while being coupled to the grip apparatus 100. The spinning motion may allow a user to take advantage of unconventional weight stress created by using off-balance weights during the user's workouts. In other optional embodiments, the at least one recess 106 may extend substantially toward the center of the weight plate 102, as shown in FIG. 3C.

As illustrated in FIG. 4, each of the at least one coupler 114 may be attached to the distal end 122 of each of the at least one adapter element 112. In accordance with this embodiment, the at least one coupler 114 may frictionally engage the rim 108 of the weight plate 102 by adjusting the at least one adapter element 112.

Figure 5:
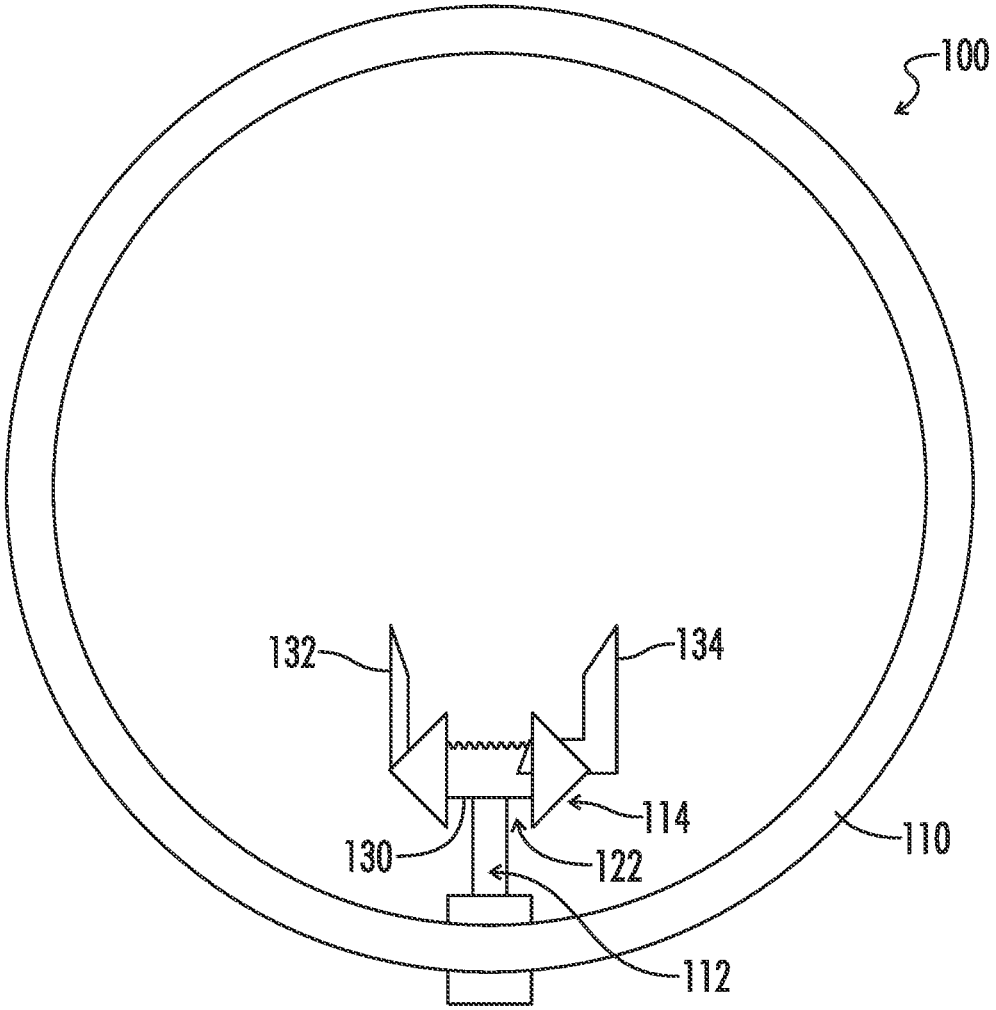
FIG. 5 illustrates a front elevation view of the grip apparatus of FIG. 3A including an embodiment of a clamp coupler in accordance with the present disclosure.
Figure 6:
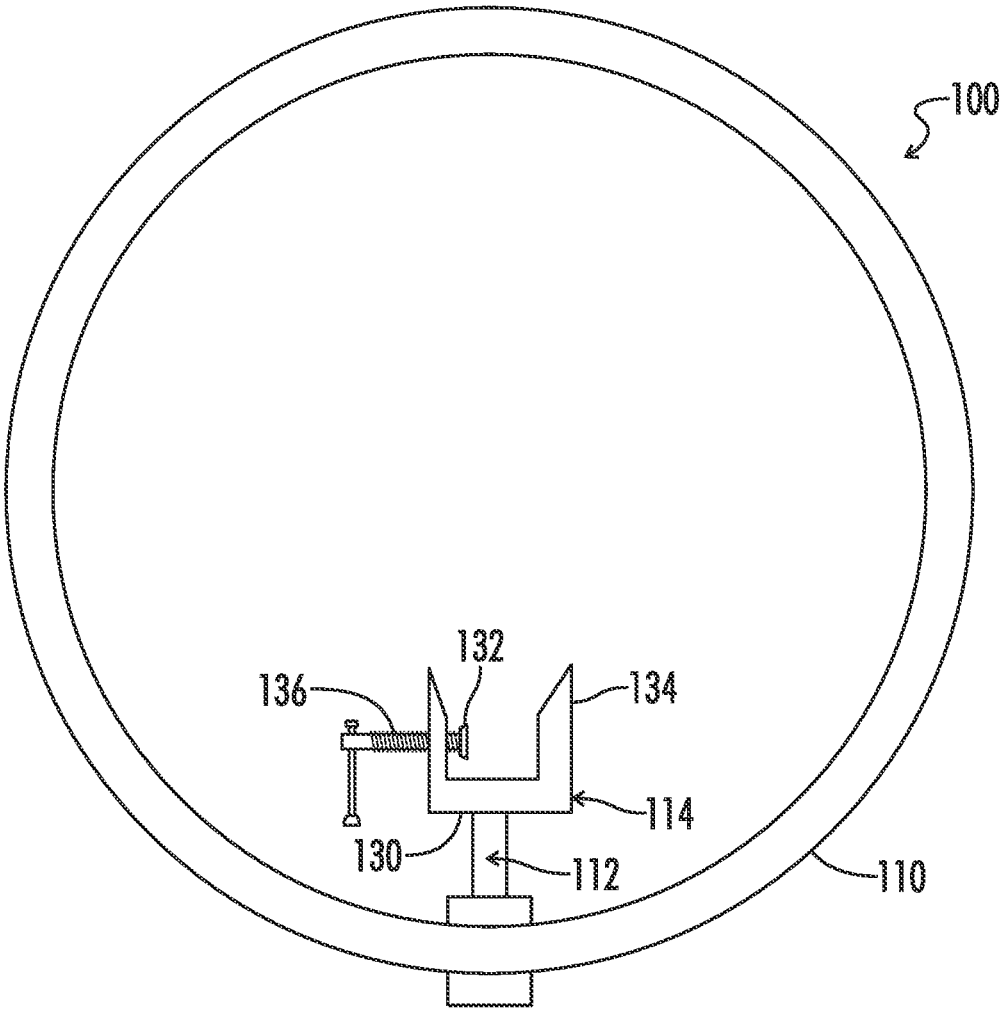
FIG. 6 illustrates a front elevation view of the grip apparatus of FIG. 5 including another embodiment of a clamp coupler in accordance with the present disclosure.
Figure 7:
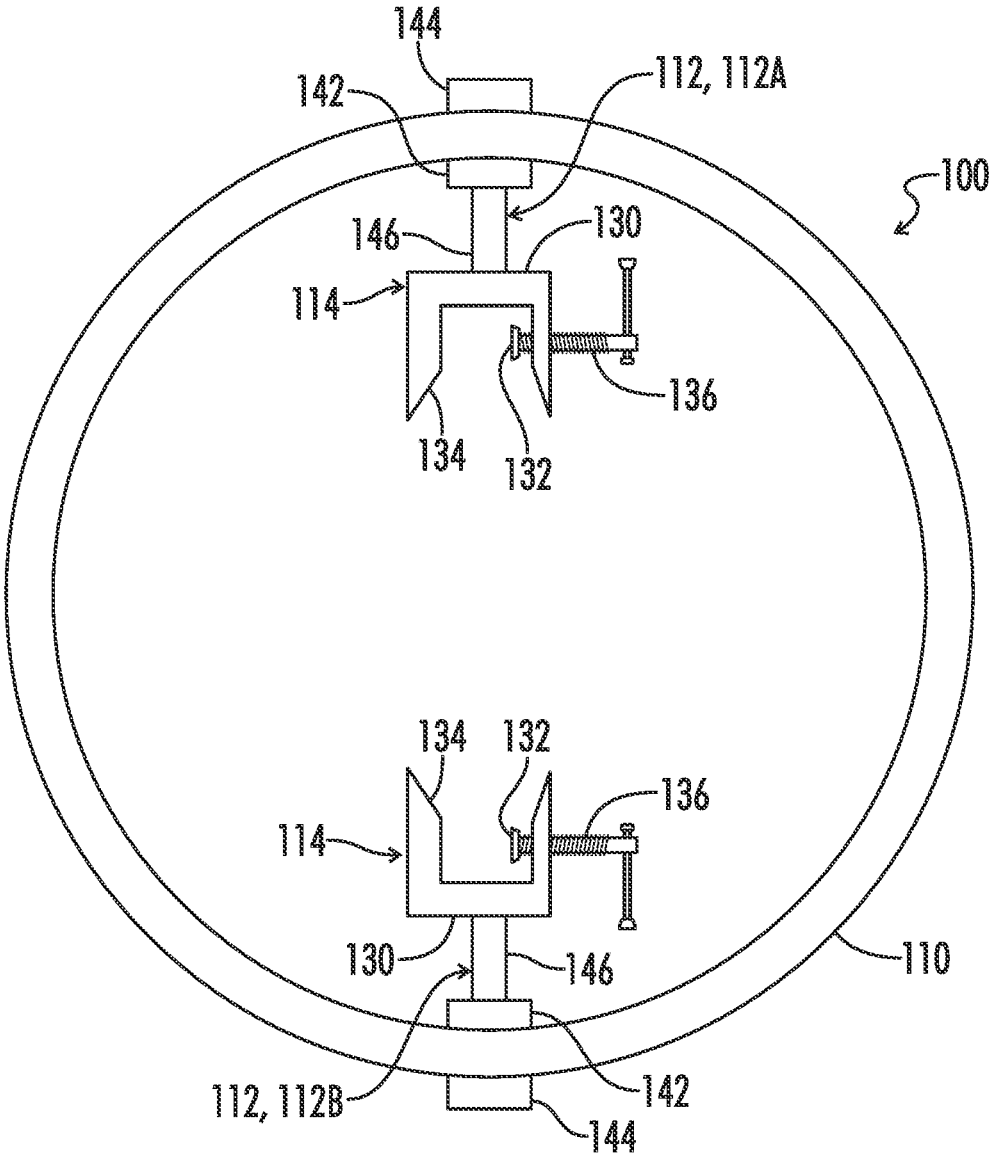
FIG. 7 illustrates a front elevation view of the grip apparatus of FIG. 6 including two clamp couplers in accordance with the present disclosure.

As illustrated in FIGS. 5-7, each of the at least one coupler 114 may be attached to the distal end 122 of each of the at least one adapter element 112. In accordance with this embodiment, the at least one coupler 114 may clamp onto the rim 108 of the weight plate 102. For example, the at least one coupler 114 may include a clamp base 130 and first and second engagement panels 132, 134 extending from the clamp base 130 and positioned parallel to each other. At least one of the first and second engagement panels 132, 134 may be moveable relative to the clamp base 130. As illustrated in FIG. 5, the first engagement panel 132 may be fixed relative to the clamp base 130 and the second engagement panel 134 may be moveable relative to the clamp base 130. In accordance with this embodiment, the second (or moveable) engagement panel 134 may be adjusted in its position relative to the first (or fixed) engagement panel 132 via the clamp base 130 such that the first and second engagement panels 132, 134 may engage two separate sides of the weight plate 102.

As illustrated in FIGS. 5 and 6, the at least one coupler 114 comprises a single coupler and as illustrated in FIG. 7, the at least one coupler 114 comprises two couplers. As illustrated in FIGS. 6 and 7, both the first and second engagement panels 132, 134 may be fixed relative to the clamp base 130. In accordance with this embodiment, at least one of the first and second engagement panels 132, 134 includes an adjustment screw 136 adjustable positioned therethrough such that the adjustment screw and the opposite engagement panel may both engage the weight plate 102, holding the grip handle 110 in a substantially fixed position relative to the grip handle 110. In accordance with these embodiments of the at least one coupler 114, the offset distance 124 (described below) may still be adjustable via the at least one adapter element 112.

The grip handle 110 may be spaced apart from the rim 108 of the weight plate 102 by an offset distance 124. The offset distance 124 may be less than or equal to a length 126 of the at least one adapter element 112. In certain optional embodiments, the offset distance 124 may be greater than or equal to about 1 inch and less than or equal to about 3 inches. In other optional embodiments, the offset distance may be greater than or equal to about 3 inches based on the weight plate diameter 104.

The at least one adapter element 112 may be adjustably configured to bridge the offset distance 124 such that at least one of the at least one adapter element 112 or the at least one coupler 114 may engage the rim 108 of the weight plate 102. The at least one adapter element 112 may be coupled to the grip handle 110 in such a way that the offset distance 124 is adjustable. For example, the at least one adapter element 112 may include a rod 140 positioned through the grip handle 110, an inner bumper 142 coupled to the rod 140 between the grip handle 110 and the distal end 122, and an outer bumper 144 coupled to the rod 140 and positioned on an opposite side of the grip handle 110 relative to the inner bumper 142. The rod 140 may be a pipe, dowel, screw, or the like. The outer bumper 144 may be fixedly coupled to the rod 140. The inner bumper 142 may lie flat against the grip handle 110 and may slidably or adjustably receive the rod 140. In certain optional embodiments, the rod 140 may include treading which engages at least one of the inner bumper 142 or the grip handle 110. In accordance with this embodiment, the outer bumper 144 may be manipulated to adjust the at least one coupler 114 relative to the grip handle 110. In other optional embodiments, the at least one coupler 114 may be biased away from the grip handle 110 by positioning a spring (not shown) between the at last one coupler 114 and the inner bumper 142. In still further optional embodiments, the at least one adapter element 112 may be configured to adjust a position of the at least one coupler 114 relative to the grip handle 110 using a smooth rod (e.g., circular, square, or the like), a threaded rod, of the like.

Figure 8:
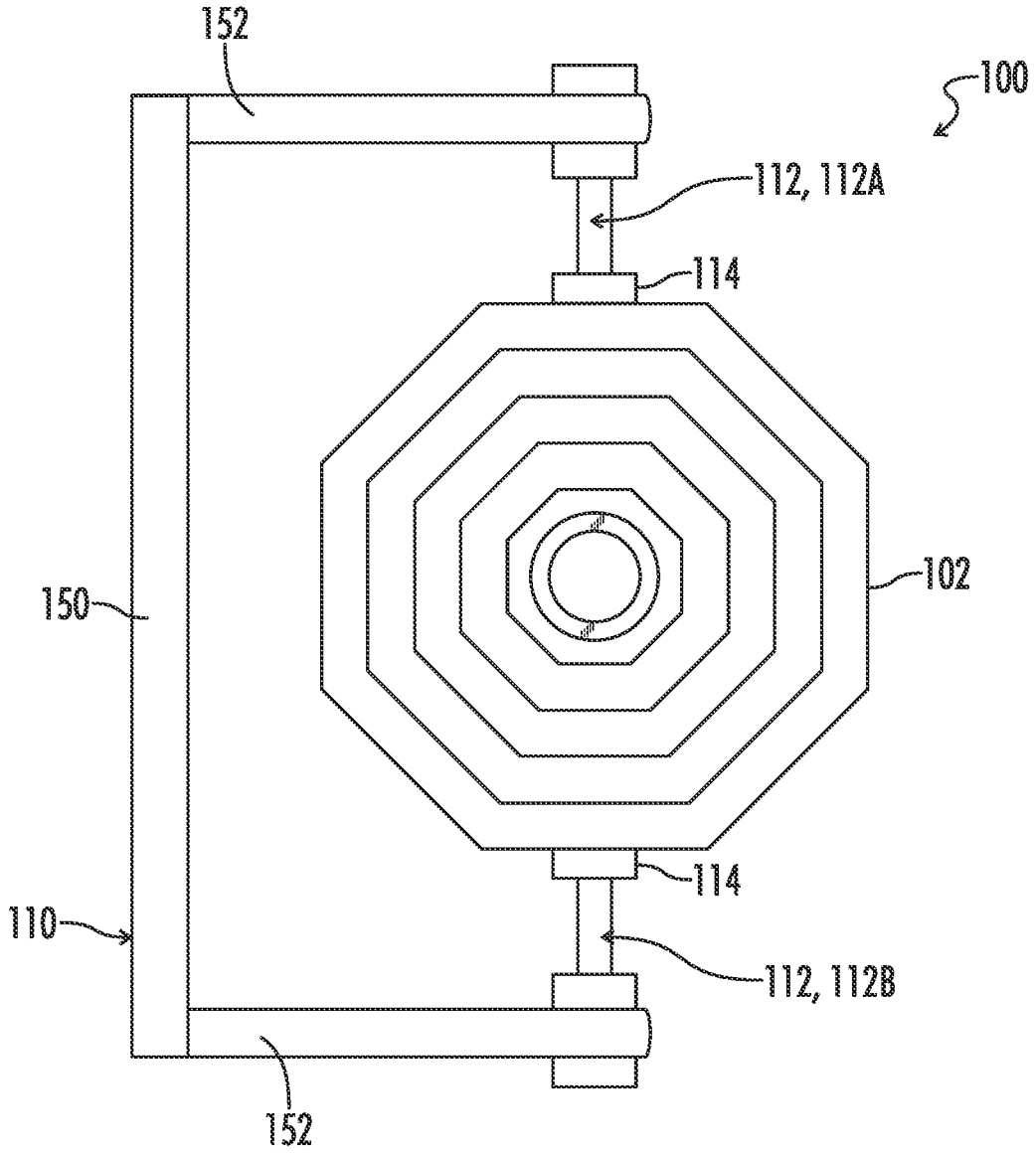
FIG. 8 illustrates a front elevation view of a workout weight plate grip system including the weight plate and the grip apparatus with a rectangular grip handle coupleable to the weight plate in accordance with the present disclosure.
Figure 9:
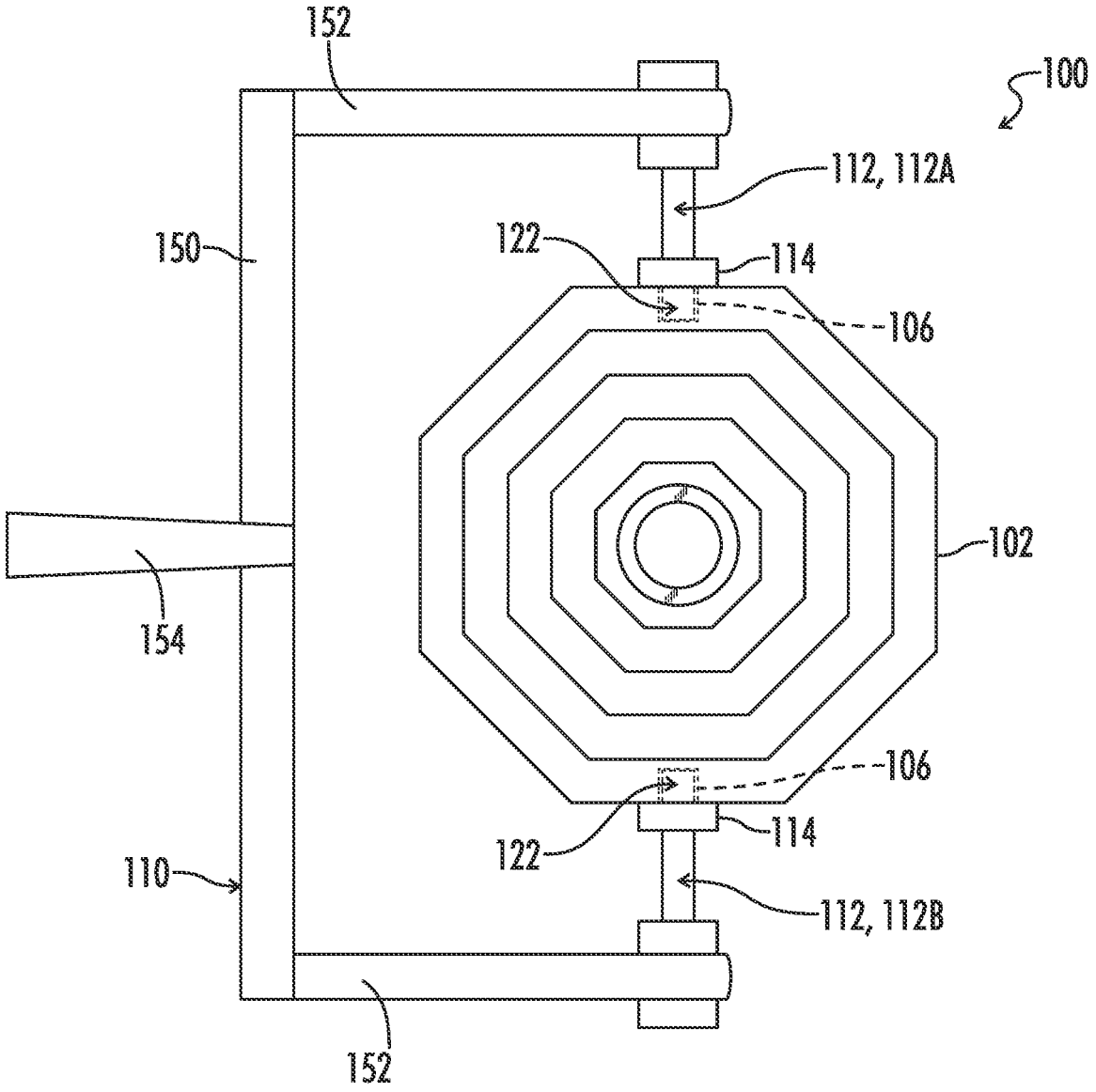
FIG. 9 illustrates a front elevation view of the workout weight plate grip system of FIG. 8 with the rectangular grip handle including an additional grip element in accordance with the present disclosure.

Referring to FIGS. 8 and 9, the grip handle 110 may be rectangular and may include a linear grip bar 150 with two coupler bars 152 extending parallel to each other from opposite ends of the linear grip bar 150. The two coupler bars 152 are positioned perpendicular to the linear grip bar 150 and may be spaced apart at a greater distance than the weight plate diameter 104. The lengths of each of the two coupler bars 152 may also be greater than half of the weight plate diameter 104. Each of the two coupler bars 152 may include one of the at least one adapter element 112 coupled thereto such that the weight plate 102 may be coupled between the two coupler bars 152. This type of arrangement of the weight plate 102 relative to the grip apparatus 100 may be accomplished using the embodiment shown in FIG. 3C by folding the two halves of the grip handle 110 together using the hinge coupler 116. As illustrated in FIG. 9, the grip handle 110 may further include an additional handle element 154 coupled to the linear grip bar 150. The additional handle element 154 may allow for additional workout movements to be performed using the grip apparatus 100.

Figure 10:
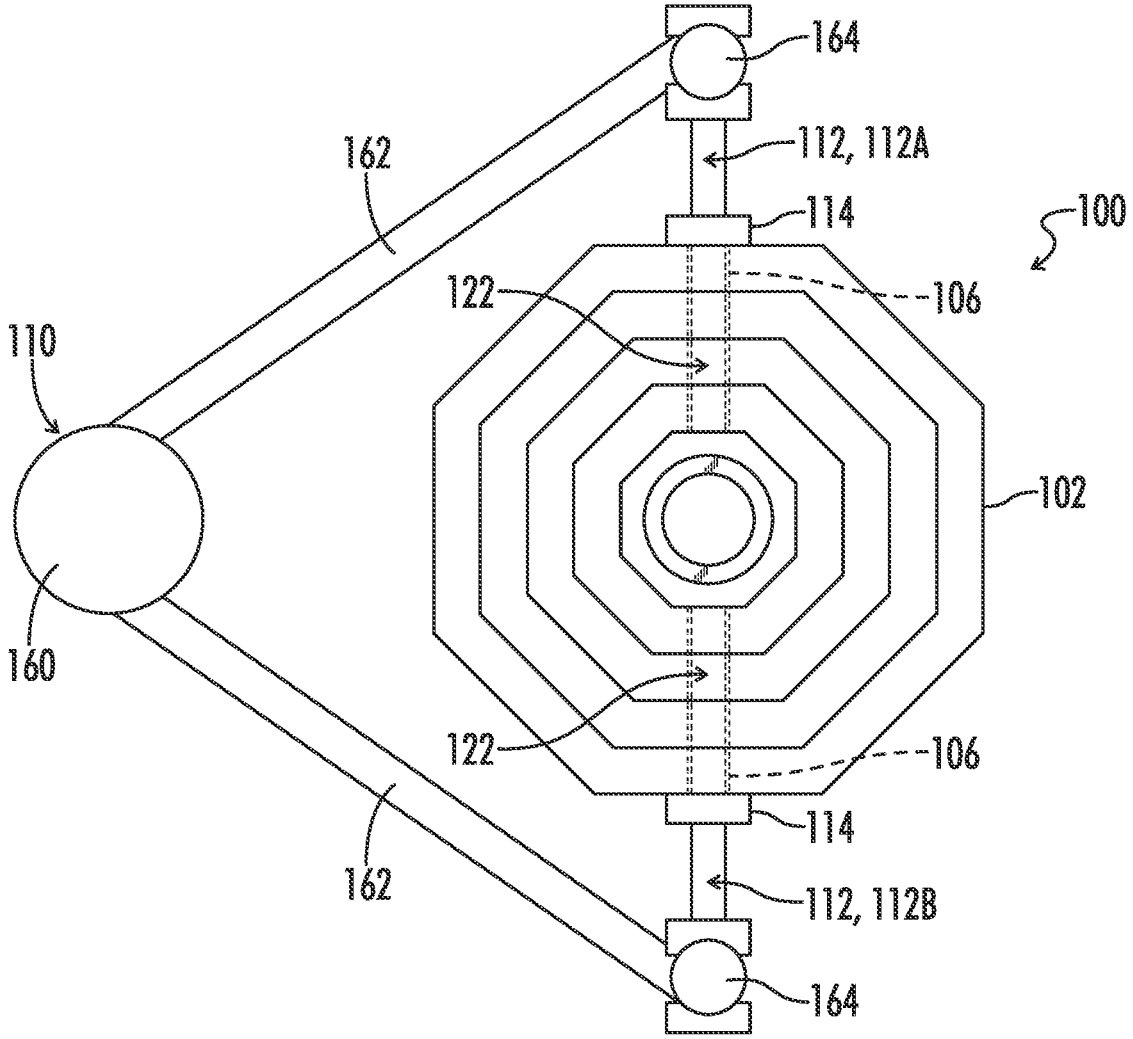
FIG. 10 illustrates a front elevation view of a workout weight plate grip system including the weight plate and the grip apparatus with a triangular grip handle coupleable to the weight plate in accordance with the present disclosure.

Referring to FIG. 10, the grip handle 110 may be triangular and may include a central handle 160 with two coupler bars 162 extending therefrom. The central handle 160 may be a spherical handle, a short bar, or the like. The central handle 160 in combination with the two coupler bars 162 form a triangular grip handle. The ends of each of the two coupler bars 162 may be equipped with ball sockets 164, each configured to receive one of two adapter elements 112 such that the two adapter elements are positioned parallel and pointed towards each other. The weight plate 102 may be configured to couple between the two adapter elements 112.

A method of installing the grip apparatus 100 onto the weight plate 102 is further disclosed herein. The method comprises step (a) positioning a grip handle 110 of the grip apparatus 100 such that it circumscribes and is offset from a rim 108 of the weight plate 102; step (b) adjusting at least one adapter element 112 of the grip apparatus 100 to cause at least one coupling means 114 of the grip apparatus 100 to engage the rim 108 of the weight plate 102; and step (c) securely fastening the at least one coupling means 114 to the rim 108 of the weight plate 102.

Step (c) of the method may further comprise inserting at least a portion of at least one of the at least one adapter element 112 or the at least one coupling means 114 into a recess 106 of the rim 108 of the weight plate 102.

Additionally, step (c) of the method may further comprise adjusting a clamp of the at least one coupling means 114 to surround and engage a portion of the rim 108 of the weight plate 102.

Step (b) of the method may further comprise moving the at least one adapter element 112 perpendicularly relative to the grip handle 110 the grip apparatus 100 to adjust a position of the at least one coupling means 114 relative to the weight plate 102.

Step (c) of the method may further comprise locking a position of the at least one adapter element 112 relative to the grip handle 110.

This written description uses examples to disclose the invention and also to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Although embodiments of the disclosure have been described using specific terms, such description is for illustrative purposes only. The words used are words of description rather than limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. While specific uses for the subject matter of the disclosure have been exemplified, other uses are contemplated. Therefore, the spirit and scope of the appended claims should not be limited to the description of the versions contained herein.

Thus, although there have been described particular embodiments of the present invention of a new and useful it is not intended that such references be construed as limitations upon the scope of this invention except as set forth in the following claims.

What is claimed is:

1. A grip apparatus for attachment to a weight, the grip apparatus comprising:

a grip handle;

at least one adapter element coupled to the grip handle and configured to adjustably extend therefrom, the at least one adapter element including a first adapter element and a second adapter element configured to engage opposite sides of the weight; and at least one coupler configured to selectively engage the weight, each of the at least one coupler respectively attached to a distal end of each of the first and second adapter elements.

2. The grip apparatus of claim 1, wherein:

the grip handle is a circular grip.

3. The grip apparatus of claim 2, wherein:

the weight includes a weight diameter; and the circular grip includes a grip handle diameter larger than the weight diameter.

4. The grip apparatus of claim 2, wherein:

the first and second adapter elements are equally spaced around the circular grip.

5. The grip apparatus of claim 1, wherein:

the grip handle is configured to circumscribe the weight.

6. The grip apparatus of claim 5, wherein:

the at least one adapter element is configured to bridge an offset between the grip handle and the weight such that at least one of the at least one adapter element or the at least one coupler can engage the weight.

7. The grip apparatus of claim 1, wherein:

the at least one coupler is configured to frictionally engage a rim of the weight.

8. The grip apparatus of claim 1, wherein:

the at least one coupler is configured to clamp onto a rim of the weight.

9. A workout weight plate grip system comprising:

a weight plate including a rim;

a grip apparatus configured to be coupled to the rim of the weight plate, the grip apparatus including:

a grip handle configured to circumscribe at least a portion of the rim of the weight plate;

at least one adapter element coupled to the grip handle and configured to adjustably extend therefrom; and at least one coupler respectively connected to a distal end of each of the at least one adapter element, the at least one coupler configured to selectively engage the weight plate.

10. The workout weight plate grip system of claim 9, wherein:

the grip handle is spaced apart from the rim of the weight plate by an offset distance; and the offset distance is less than or equal to a length of the at least one adapter element.

11. The workout weight plate grip system of claim 10, wherein:

the offset distance is greater than or equal to about 1 inch and less than or equal to about 3 inches.

12. The workout weight plate grip system of claim 9, wherein:

the weight plate includes at least one recess defined in the rim; and at least one of the at least one adapter element or the at least one coupler is configured to be at least partially inserted into the at least one recess of the weight plate.

13. The workout weight plate grip system of claim 9, wherein:

the at least one coupler is configured to frictionally engage the rim of the weight plate.

14. The workout weight plate grip system of claim 9, wherein:

the at least one coupler is configured to clamp onto the rim of the weight plate.

15. A method of installing a grip apparatus onto a weight plate, the method comprising:

(a) positioning a grip handle of the grip apparatus such that it circumscribes and is offset from a rim of the weight plate;

(b) adjusting at least one adapter element of the grip apparatus to cause at least one coupling means of the grip apparatus to engage the rim of the weight plate; and (c) securely fastening the at least one coupling means to the rim of the weight plate.

16. The method of claim 15, wherein step (c) further comprises:

inserting at least a portion of at least one of the at least one adapter element or the at least one coupling means into a recess of the rim of the weight plate.

17. The method of claim 15, wherein step (c) further comprises:

adjusting a clamp of the at least one coupling means to surround and engage a portion of the rim of the weight plate.

18. The method of claim 15, wherein step (b) further comprises:

moving the at least one adapter element perpendicularly relative to an attachment location on the grip apparatus to adjust a position of the at least one coupling means relative to the weight plate.

19. The method of claim 18, wherein step (c) further comprises:

locking a position of the at least one adapter element relative to the grip handle.

* * * * *